US005320060A

United States Patent [19]

Gunter

[11] Patent Number: 5,320,060

[45] Date of Patent: Jun. 14, 1994

[54] ADJUSTABLE PEDESTAL AND SADDLE FOR BOATS

[75] Inventor: Ernest G. Gunter, 907 Hillcrest St., Placerville, Calif. 95667

[73] Assignee: Ernest Gunter, Placerville, Calif.

[21] Appl. No.: 34,491

[22] Filed: Mar. 19, 1993

[51] Int. Cl.[5] ..... B63B 17/00

[52] U.S. Cl. ..... 114/363; 248/424; 297/344.1; 297/195.11

[58] Field of Search ..... 114/347, 363, 39.2; 248/416, 419, 424; 297/344, 195, 344.1, 195.11

[56] References Cited

U.S. PATENT DOCUMENTS 4,229,850 10/1980 Arcouette ..... 114/347

4,266,707 5/1981 Rossman ..... 114/363 X 4,503,799 3/1985 Masters ..... 114/347 X

FOREIGN PATENT DOCUMENTS 3234124 3/1984 Fed. Rep. of Germany ..... 114/39.2

3339883 5/1985 Fed. Rep. of Germany ..... 114/363

*Primary Examiner*—Sherman Basinger

[57] ABSTRACT

The device includes a microcell foam pedestal structure which is attached to the inside hull along the keel of a boat, such as a canoe. One or more saddles are mounted onto the pedestal structure in a variety of locations. The saddle can be adjusted along the length of the pedestal structure allowing the paddler(s) the flexibility to move in order to maintain the proper trim of the boat.

9 Claims, 2 Drawing Sheets

ADJUSTABLE PEDESTAL AND SADDLE FOR BOATS

REFERENCE CITED

U.S. Patent Documents

U.S. Pat. No. 4,503,799 filed May, 1985 to Masters—114/363

BACKGROUND OF THE INVENTION

1. Field of the Invention.

This invention relates to auxiliary equipment for small boats, and more particularly to such equipment adapted to provide adjustable seating and flotation for boats, such as canoes.

2. Discussion of Related Art.

For many years canoes have been used for pleasure boating on lakes and rivers and an increasing number of canoeist are enjoying the thrill of whitewater rivers. New boat designs are allowing canoeist to challenge rivers never thought boatable in the past. As more people get involved in the sport of whitewater canoeing they are finding that they need a pedestal type saddle to provide the extra control and stability necessary to handle the stronger, more forceful whitewater rivers.

It is important that a canoe be properly "trimmed" (weight distributed correctly) so that the boat will perform to its maximum design capabilities. In solo canoeing it is desirable to position the paddler in such a way that the bow is slightly light. Having an adjustable pedestal and saddle would allow more than one paddler to use the same boat and also allow the paddler to adjust his/her position in the boat according to the amount of gear being transported.

The height of seat, or "saddle" is also important to the control of the boat and the comfort of the paddler. If a canoeist sits too low, his/her ankles and knees become fatigued, if a canoeist sits too high, stability decreases and there can be painful pressure applied to the knee cap. When canoeing in rough water all these factors can contribute to the canoeist control of the boat and how successful and enjoyable that run will be.

In tandem canoeing there is a similar problem with trim. It is rare for two boaters of the same height and weight to be canoeing together and it is often desirable for paddlers to change paddling position throughout a trip. Presently, canoes are rigged so that the pair pick a position and set that position up to fit their height, and the trim requirements of the boat while paddling in that position. A problem is encountered when the pair wish to paddle at different ends of the boat or someone else a different size wants to paddle the boat. Often this results in the boat being out of trim, and/or the canoeist sitting in a position of discomfort, rather than comfort. Control and maneuverability may also be sacrificed. It is desirable to have a device that would allow paddlers to change positions in a boat while maintaining proper weight distribution for maximum control of the boat and comfort of the paddler.

Whitewater Canoes are usually manufactured as bare hulls with little flotation except for the materials used in the construction of the boat itself. In whitewater canoeing it is important to increase the flotation of the boat in case of a turn over. In a turn over extra flotation causes the boat to float higher making it easier for the paddler to hang on to the boat and also making it easier to right the canoe.

Whitewater canoeing subjects the hull of the boat to a considerable amount of pounding from rock submerged under the water and in the case of a turn over, from the pressure of the rushing water. Many canoes used today on whitewater rivers are weak in the keel area. It is desirable to install a device that would increase rigidity to that area to aid in the structural support of the boat.

SUMMARY OF INVENTION

One object of this invention is to provide a structure that can be inserted into a boat to increase flotation of that boat.

A further object of the present invention is to provide a structure that can be inserted into a boat with adjustments fore and aft to allow the boaters to trim the boat easily.

A further object of the present invention is to provide a structure that can be inserted into a boat, that will allow separate height adjusted saddles to be positioned at given points anywhere along the entire length of the structure.

A further object of the present invention is to provide a structure that can be inserted into a boat, that will increase structural integrity of the boat.

In accordance with the above and other objects, the present invention consists of two main pieces, the pedestal structure itself and the saddle that sits atop the structure. The pedestal structure consists of two microcell foam blocks and is designed to be mounted in a canoe by means of an adhesive. The bottom of the structure can be conformed to the hull of the canoe being fitted. Sandwiched between the two microcell blocks is an acrylic sheet with a row of teeth cut into the top, the crowns of the teeth lay flush with the top of the two microcell blocks. A strip of loop fastener is mounted on the tops of the two microcell blocks running the entire length of the blocks. The pedestal structure can be made any length.

The saddle consists of a microcell foam block that can be conformed to the shape and height of the user. Inserted into the bottom of the block are teeth that match the teeth of the pedestal structure. On the bottom of the saddle are patches of hook fastener that mate with the loop fastener of the pedestal structure when the saddle is mounted. Depending on the length of the pedestal structure two or more saddles can be mounted on the structure at the same time.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
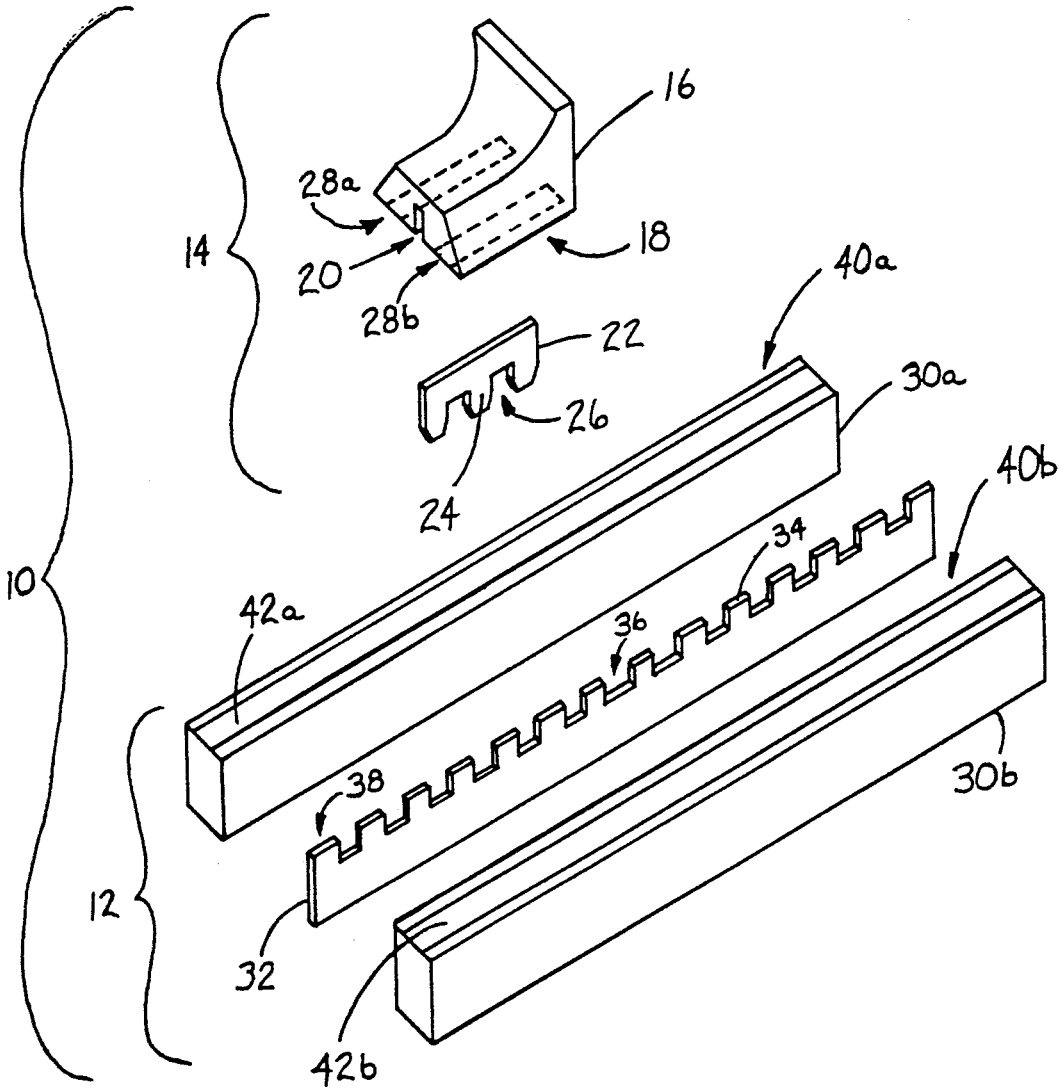
FIG. 1 is an exploded view of the apparatus of the present invention showing the pedestal structure and one saddle.
Figure 2:
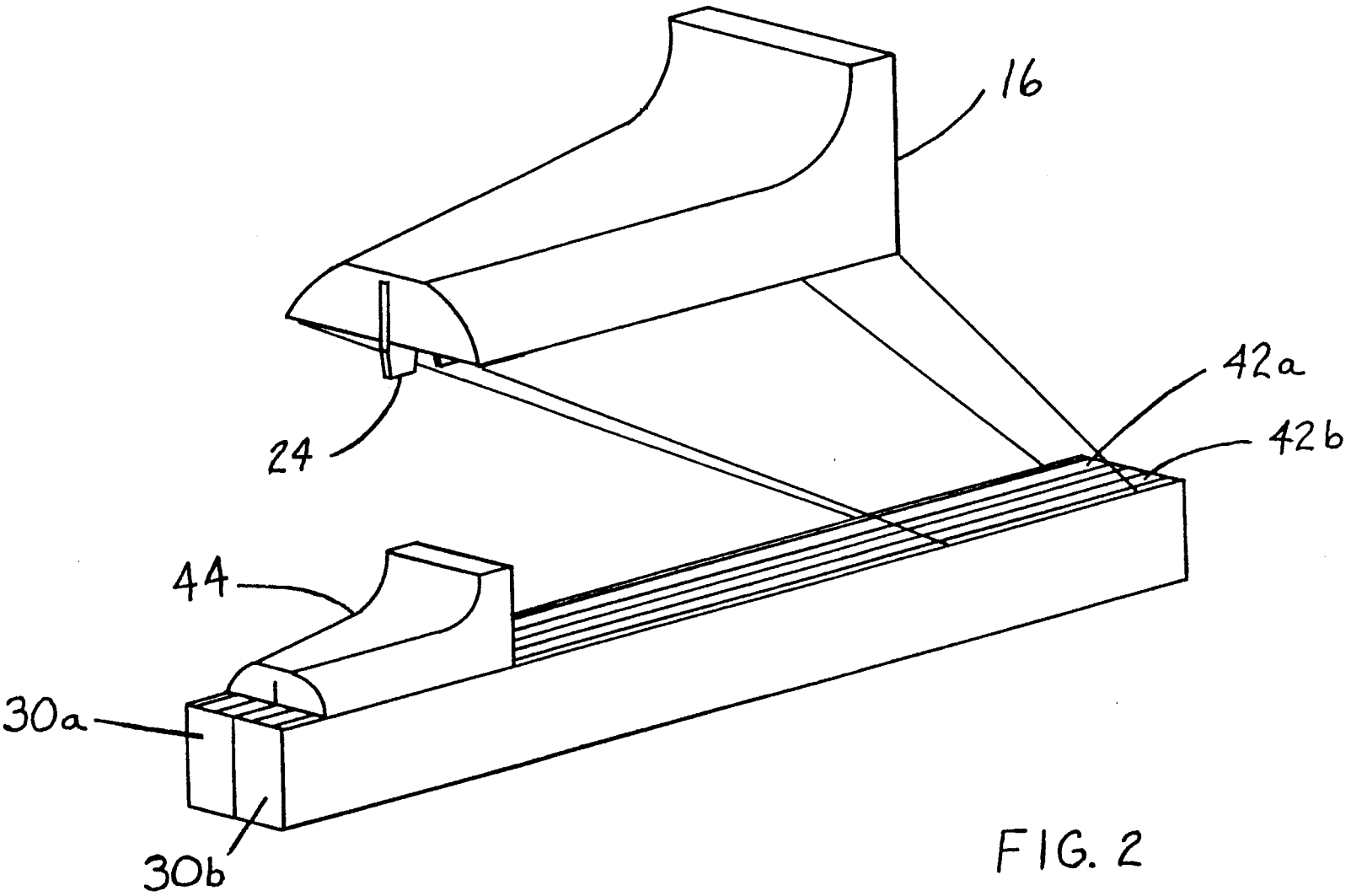
FIG. 2 is an isometric view of the present invention showing the assembly of FIG. 1 and one saddle mounted and one saddle unmounted.

Referring more specifically to the drawings, for illustrative purposes the present invention is embodied in the apparatus generally shown in FIG. 1 and FIG. 2. It will be appreciated that the apparatus may vary as to configuration and as to details of the parts without departing from the basic concepts as disclosed herein.

Referring to FIG. 1, an adjustable seat apparatus 10 in accordance with the present invention includes a pedestal 12 which serves as a support structure for mounting in a watercraft such as a canoe or the like, and a seat 14 which is coupled to pedestal 12. Seat 14 includes a saddle portion 16 which can be sized and shaped to conform to the body shape and height of the individual who will be using it. Disposed in the generally flat bottom 18 of saddle 16 is a slot 20. Slot 20 receives a seat connector 22 having one or more prongs or teeth 24 and one or more receptacles 26. In this manner, teeth 24 will extend outwardly from the bottom of saddle 16. Preferably, saddle 16 is fabricated from a microcell foam material or the like which is lightweight and floats, and seat connector 22 is fabricated from a rigid material such as acrylic or the like. Those skilled in the art will appreciate that teeth 24 could be alternatively be integrally formed with saddle 16. Additionally, coupled to bottom 18 of saddle 16 are strips or patches of hook fastener material 28*a*, 28*b*.

Pedestal 12 includes a plurality of blocks 30*a*, 30*b*, which are also preferably fabricated from a microcell foam material or the like. Sandwiched between opposing faces of blocks 30*a*, 30*b* is a pedestal connector 32 which is preferably fabricated from an rigid material such as acrylic or the like. Pedestal connector 32 includes a plurality of teeth 34 and receptacles 36. Preferably, the crowns 38 of teeth 34 lay flush with the top surfaces 40*a*, 40*b* of blocks 30*a*, 30 *b* respectively. For stability and strength, blocks 30*a*, 30*b* and pedestal connector 32 are preferably adhesively coupled to form a unitary structure. Those skilled in the art will appreciate that pedestal 12 could be fabricated as a single piece of microcell foam material or the like with receptacles 36 extending inwardly from its top surface. Additionally, coupled to the top surface of the foam blocks are strips 42*a*, 42*b* of loop fastener material which run the entire length of the blocks.

It can be seen therefore, that seat 14 can be placed atop pedestal 12 by inserting teeth 24 on seat 14 into receptacles 36 on pedestal 12. When this occurs, teeth 34 on pedestal 12 will fit into receptacles 26 on seat 14. In this way, the teeth and receptacles will interlock to provide fore and aft stability. In addition, the user can adjust the position of seat 14 longitudinally along pedestal 12. And, lateral stability results from the contact between the bottom surface of seat 14 and the top surface of pedestal 12. Therefore, the user is provided with an adjustable, stable and secure paddling platform.

Note also, that when seat 14 is placed atop pedestal 12, hook fasteners 28*a*, 28*b* and loop fasteners 42*a*, 42*b*, which can be Velcro ® or the like, mesh and couple to prevent separation of pedestal 12 and seat 14 during transportation of the boat or during an upset or capsizing while in the water.

Preferably, pedestal 12 is securely mounted in a watercraft such as a canoe by means of an adhesive, and the shape thereof can be conformed to the shape of the hull of the watercraft in which it is mounted. However, the top side of pedestal 12 should be generally flat so as to match the flat contour of the bottom side of seat 14.

Referring also to FIG. 2, it can be seen that the length of pedestal 12 is not critical and that pedestal 12 can be lengthened to accommodate an additional seat 44 if desired.

Accordingly, it will be seen that this invention provides a conveniently adjustable seat for a watercraft such as a canoe, and adds flotation thereto. Adjustment of the seat position is facilitated through the use of the interlocking teeth, and separation of the seat and pedestal is prevented when capsized by means of a hook and loop fasteners between the seat and pedestal. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An adjustable seat apparatus for mounting in a watercraft, comprising:
   (a) a seat, said seat including a bottom surface, said seat including at least one prong extending outward from said bottom surface;
   (b) a support structure, said support structure including a top surface, said support structure including a plurality of receptacles extending inwardly from said top surface, said receptacles positioned longitudinally along said support structure; and
   (c) said support structure comprises a first foam block, a second foam block and an acrylic sheet, said acrylic sheet disposed between opposing faces of said foam blocks, said foam blocks and said acrylic sheet being adhesively coupled and forming a unitary structure.

2. An apparatus as recited in claim 1, wherein hook and loop fastener means for coupling said bottom surface of said seat to said top surface of said support structure, wherein said prong is received by a one of said receptacles for longitudinal adjustment of said seat in relation to said support structure and said hook and loop fastener means holds said seat to said support structure and within said watercraft when said watercraft is capsized.

3. An apparatus as recited in claim 2, wherein said hook and loop fastener means comprises:
   (a) at least one strip of loop fastener material coupled to said support structure and extending longitudinally along said support structure; and
   (b) at least one patch of hook fastener material coupled to said seat.

4. An apparatus as recited in claim 1, wherein said acrylic sheet includes a top side, and said receptacles are disposed in said top side of said acrylic sheet.

5. An apparatus as recited in claim 4, wherein said receptacles comprise a plurality of interlocking teeth, said teeth having crowns, said crowns lying flush with said top surface of said support structure.

6. An apparatus as recited in claim 5, wherein said prong interlocks with said interlocking teeth.

7. An adjustable saddle seat and support pedestal for mounting in a watercraft, comprising:
   (a) a support pedestal, said support pedestal including a first foam block, a second foam block and an acrylic sheet, said acrylic sheet disposed between opposing faces of said foam blocks, said foam blocks and said acrylic sheet being adhesively coupled and forming a unitary structure, said support pedestal including a top surface, said acrylic sheet including a plurality of receptacles extending inwardly from said top surface and positioned longitudinally along said support pedestal;
   (b) a saddle seat, said saddle seat including a bottom surface, said saddle seat including at least one prong extending outward from said bottom surface; and (c) hook and loop fastener means for coupling said bottom surface of said saddle seat to said top surface of said support pedestal, wherein said prong is received by a one of said receptacles for longitudinal adjustment of said seat in relation to said support structure and said hook and loop fastener means holds said seat to said support structure and within said canoe when said watercraft is capsized.

8. An apparatus as recited in claim 7, wherein said hook and loop fastener means comprises:

(a) a plurality of strips of loop fastener material coupled to said support structure and extending longitudinally along said support structure; and (b) a plurality of patches of hook fastener material coupled to said saddle seat.

9. A saddle seat and a pedestal structure for mounting said saddle seat in a canoe, comprising:

(a) a first microcell foam block and a second microcell foam block;

(b) an acrylic sheet, said sheet having a top side and a bottom side, said top side having interlocking teeth cut thereinto;

(c) said first and second microcell foam blocks having facing surfaces, said acrylic sheet being sandwiched between said facing surfaces and held to said facing surfaces with adhesive;

(d) each of said first and second microcell foam blocks having substantially planar top surfaces, said teeth of said acrylic sheet having crowns, said crowns lying flush with said top surfaces of said first and second microcell foam blocks;

(e) each of said top surfaces of said microcell foam blocks having a strip of loop fastener material fastened to and extending along the length thereof;

(f) wherein said first and second microcell foam blocks and said acrylic sheet form said pedestal structure;

(g) said saddle seat having a bottom surface, teeth located on said bottom surface and extending downwardly therefrom, said teeth being adapted to interlock the teeth of said acrylic sheet;

(h) said bottom surface of said saddle seat further having mounted thereon patches of hook fastener, said hook fastener being adapted to engage said loop fastener to further hold said saddle seat in said canoe; and (i) wherein said pedestal structure mounts said saddle seat within said canoe for longitudinal adjustment thereof and said hook and loop fasteners hold said saddle seat to said pedestal structure and within said canoe when said canoe is capsized.

* * * * *